US010476209B2

(12) United States Patent
Kitagawa et al.

(10) Patent No.: US 10,476,209 B2
(45) Date of Patent: Nov. 12, 2019

(54) SHIELD CONNECTOR

(71) Applicant: SUMITOMO WIRING SYSTEMS, LTD., Yokkaichi-shi, Mie (JP)

(72) Inventors: Masaru Kitagawa, Yokkaichi (JP); Shinyu Nagashima, Yokkaichi (JP); Masaki Okamoto, Yokkaichi (JP); Yasuhiro Kudo, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/301,626

(22) PCT Filed: May 12, 2017

(86) PCT No.: PCT/JP2017/017988
§ 371 (c)(1),
(2) Date: Nov. 14, 2018

(87) PCT Pub. No.: WO2017/208779
PCT Pub. Date: Dec. 7, 2017

(65) Prior Publication Data

US 2019/0296494 A1 Sep. 26, 2019

(30) Foreign Application Priority Data

Jun. 1, 2016 (JP) ..... 2016-110097

(51) Int. Cl.
*H01R 13/6581* (2011.01)
*H01R 13/639* (2006.01)
(Continued)

(52) U.S. Cl.
CPC ..... *H01R 13/6581* (2013.01); *H01R 13/5205* (2013.01); *H01R 13/621* (2013.01);
(Continued)

(58) Field of Classification Search
CPC ..... H01R 13/639; H01R 13/5205; H01R 13/748; H01R 13/621;
(Continued)

(56) References Cited

U.S. PATENT DOCUMENTS 4,557,545 A 12/1985 Ohtsuki et al.
6,077,115 A * 6/2000 Yang ..... H01R 13/658 439/567
(Continued)

FOREIGN PATENT DOCUMENTS

JP S59-166382 U 11/1984
JP 2011-048949 A 3/2011
(Continued)

OTHER PUBLICATIONS

Aug. 8, 2017 International Search Report issued in International Patent Application No. PCT/JP2017/017988.
(Continued)

*Primary Examiner* — Gary F Paumen
(74) *Attorney, Agent, or Firm* — Oliff PLC

(57) ABSTRACT

A shield connector includes a first housing and a second housing, a first shield shell configured to cover the first housing, and a second shield shell configured to cover the second housing. The first shield shell includes a first connecting portion and the second shield shell includes a second connecting portion. An electrically conductive fastening member electrically connects the first connecting portion and the second connecting portion to each other. The first housing includes a first fixing portion, and the second housing includes a second fixing portion. The first fixing portion and the second fixing portion are held together by the fastening member in a state in which the first fixing portion and the second fixing portion are interposed between the first connecting portion and the second connecting portion.

9 Claims, 10 Drawing Sheets

(51) Int. Cl.
*H01R 13/52* (2006.01)
*H01R 13/74* (2006.01)
*H01R 13/6591* (2011.01)
*H01R 13/621* (2006.01)

(52) U.S. Cl.
CPC ..... *H01R 13/639* (2013.01); *H01R 13/6591* (2013.01); *H01R 13/748* (2013.01)

(58) Field of Classification Search
CPC ..... H01R 13/6581–6597; H01R 13/65802; H01R 13/658; H01R 13/6215; H01R 23/6873; H01R 23/688
USPC ..... 439/607.01–607.59, 362–364
See application file for complete search history.

(56) References Cited

U.S. PATENT DOCUMENTS 6,203,377 B1 * 3/2001 Grek ..... H01R 9/032 439/607.44
6,776,665 B2 * 8/2004 Huang ..... H01R 13/6581 439/352
7,128,582 B2 * 10/2006 Fang ..... H01R 13/514 439/79
8,257,107 B2 * 9/2012 Tsuruta ..... H01R 13/6581 439/362
9,407,049 B2 * 8/2016 Ishibashi ..... H01R 13/6397
2002/0155756 A1 * 10/2002 Yoshioka ..... H01R 13/648 439/607.01
2011/0053408 A1 3/2011 Tsuruta et al.
2011/0059653 A1 * 3/2011 Yang ..... H01R 13/6594 439/607.35
2014/0030921 A1 * 1/2014 Kobayashi ..... H01R 13/6591 439/607.01
2014/0106619 A1 4/2014 Okamoto et al.
2014/0120769 A1 * 5/2014 Dang ..... H01R 13/502 439/607.05
2014/0127939 A1 5/2014 Ishibashi et al.

FOREIGN PATENT DOCUMENTS

JP 2011-086461 A 4/2011
JP 2014-078411 A 5/2014
JP 2014-093289 A 5/2014
JP 2015-082464 A 4/2015

OTHER PUBLICATIONS

Aug. 8, 2017 Written Opinion issued in International Patent Application No. PCT/JP2017/017988.

* cited by examiner

SHIELD CONNECTOR

The technology disclosed herein relates to a shield connector.

BACKGROUND

Conventionally, there are shield connectors in which connector housings are covered by shield shells to prevent leakage of noise. In this type of shield connector, shield shells are fitted over a pair of connector housings, and each shield shell is secured to a respective connector housing using, for example, a locking configuration with a locking claw or a fastening configuration with a bolt. After the pair of connector housings have been mated, they are fixed, for example, by fastening a bolt, to establish a conductive connection.

PRIOR ART DOCUMENTS

Prior Art Documents

Patent Document 1: JP 2011-086461 A
Patent Document 2: JP 2015-082464 A

SUMMARY

However, when each shield shell has been fixed to a respective connector housing using, for example, a locking mechanism with a locking claw, vibrations from, for example, a traveling vehicle, rattle the housings inside the shield shells and the connection becomes unreliable. When each shield shell has been fixed using a fastening configuration with a bolt, rattling between the shield shells and the connector housings is suppressed, but bolt fastening must be performed several times in the assembly process. This configuration also increases the number of parts and makes the assembly process more time consuming.

The technology disclosed in this specification was made based on the situation described above, and has an object of providing a shield connector with superior assembly efficiency that suppresses rattling of the housings inside the shield shells.

The technology disclosed herein is a shield connector having a first housing and a second housing fitted together and covered by shield shells, the shield shells being formed such that a first connecting portion of a first shell covering the first housing and a second connecting portion of a second shell covering the second housing are conductively connected by an electrically conductive fastening member, the first housing being provided with a first fixing portion fixed to the first shell, the second housing being provided with a second fixing portion fixed to the second shell, and the first fixing portion and the second fixing portion being fastened together by a fastening member while interposed between the first connecting portion and the second connecting portion.

In this configuration, the first shell and the second shell are fastened and attached, respectively, to the first fixing portion of the first housing and the second fixing portion of the second housing by fastening a fastening member, which makes it difficult for rattling to occur between the respective shells and the housings. Also, because the first housing and the second housing are fastened together by the fastening member, the mating of the housings is more secure and vibration resistance is improved. Conventionally, each shell is fastened to a respective housing using a separate fastening member, and then the shells are assembled using a separate fastening member. Here, by comparison, the fastening operation is more efficient as it occurs all at once.

The shield connector may have the following configuration.

An electrically conductive collar may be provided in each of the first fixing portion and the second fixing portion, and the fastening member may pass through the collars.

With this configuration, the electrical conductivity between the first shell and the second shell is maintained not only by the electrically conductive fastening member but by the electrically conductive collars as well. This can increase the reliability of shield performance.

The first fixing portion and the second fixing portion may be provided so as to stand erect in a direction orthogonal to the mating direction of the first housing and the second housing.

With this configuration, the shield connector configuration and assembly operation can be made to be comparatively simple.

A shielding portion extending in the mating direction and covering the periphery of the first fixing portion and the second fixing portion may be provided on at least one of the first connecting portion and the second connecting portion.

With this configuration, the periphery of the portions fastened by the fastener is covered by a shielding portion. This can increase the reliability of shield performance.

A temporary locking mechanism may be provided that holds and prevents detachment of the first housing and the second housing until the fastening portion of the fastening member has been fastened to the fastened portion.

With this configuration, the first housing and the second housing are suppressed from detaching before the fastening operation has been performed. This improves the assembly operation.

The technology disclosed herein is able to provide a shield connector with superior assembly efficiency that reduces rattling of the housings inside the shield shells.

DETAILED DESCRIPTION OF EMBODIMENTS

The following is a description of an embodiment with reference to FIG. 1 to FIG. 10.

Figure 1:
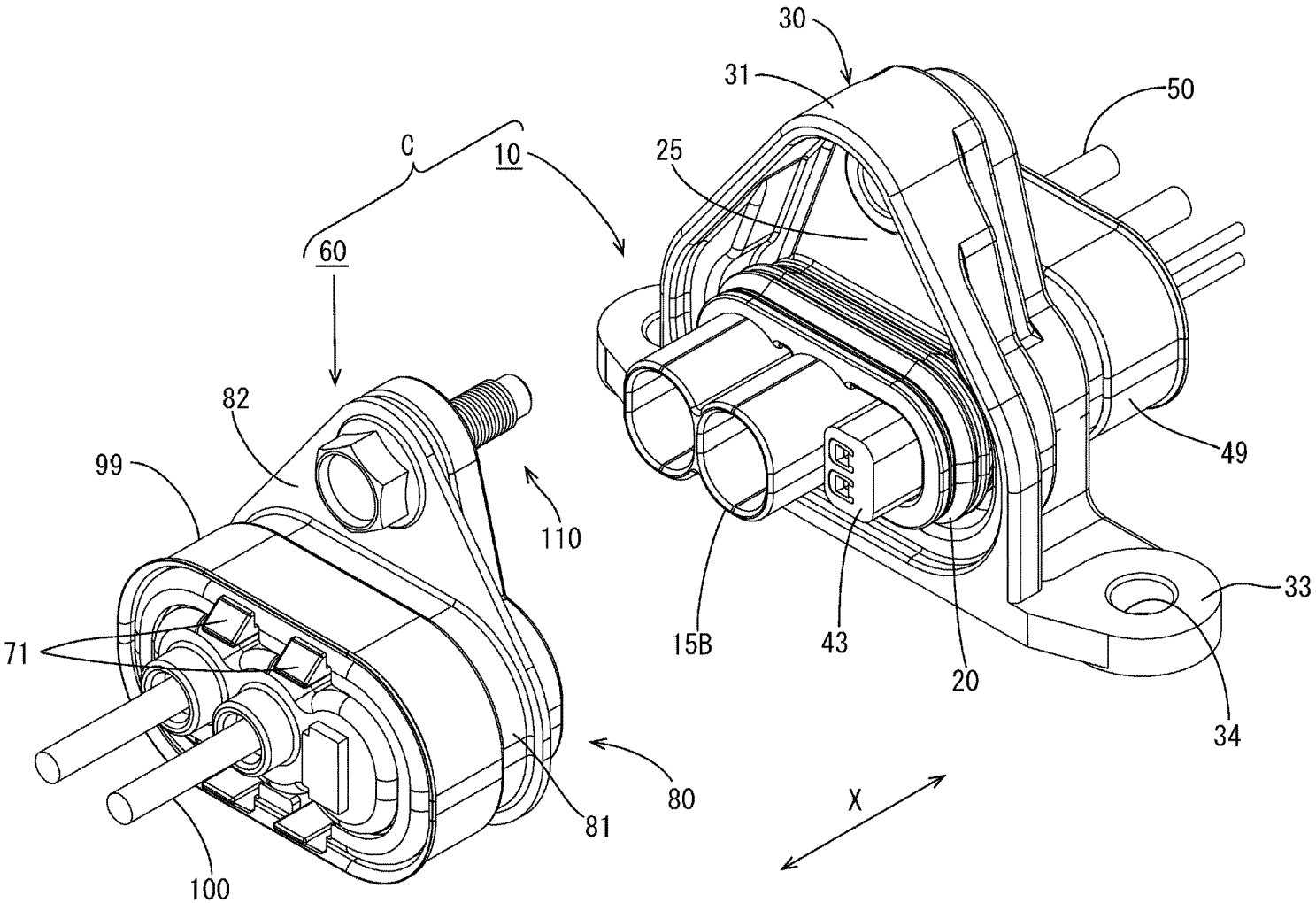
FIG. 1 is a perspective view of a shield connector in an embodiment before mating.
Figure 2:
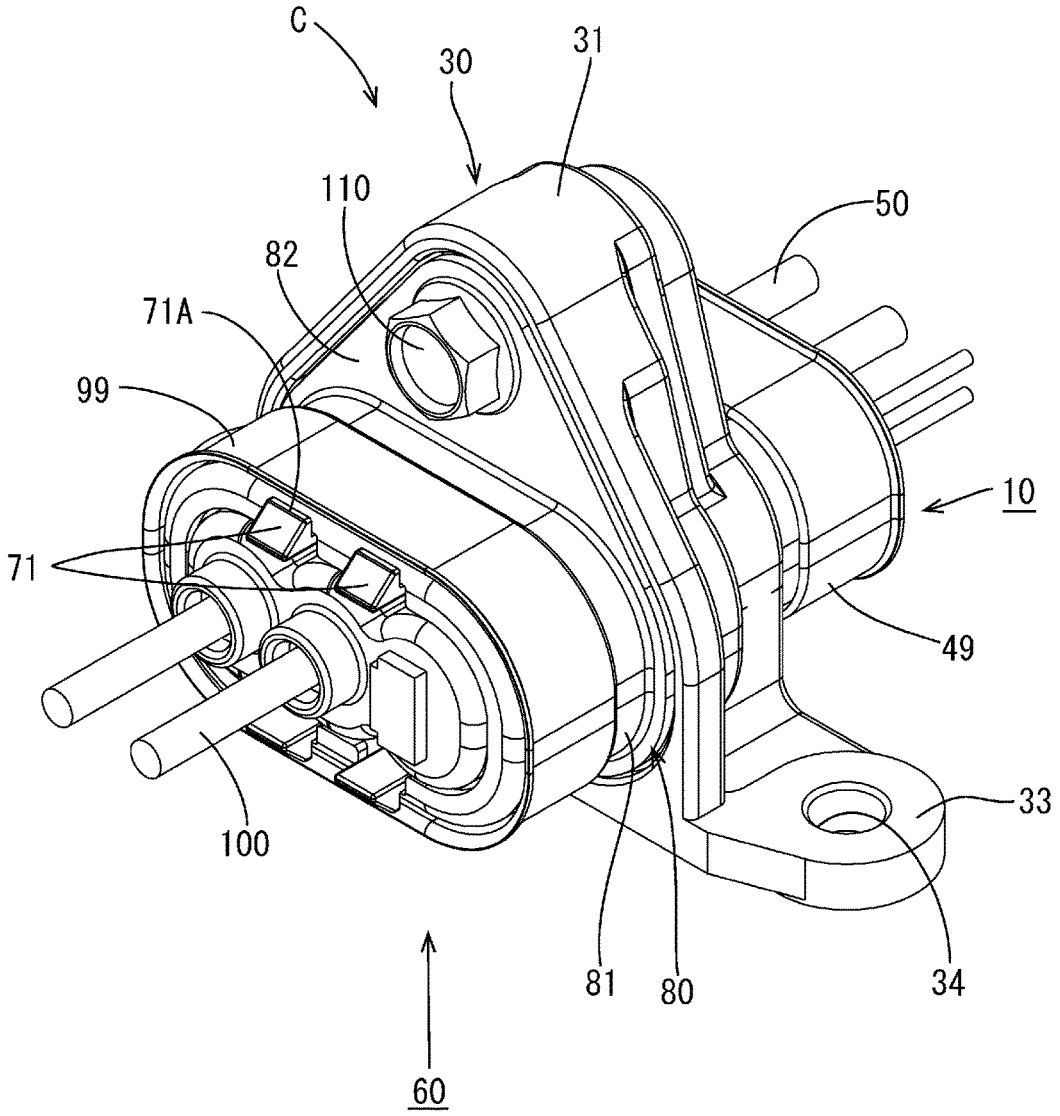
FIG. 2 is a perspective view of the shield connector when mated.
Figure 3:
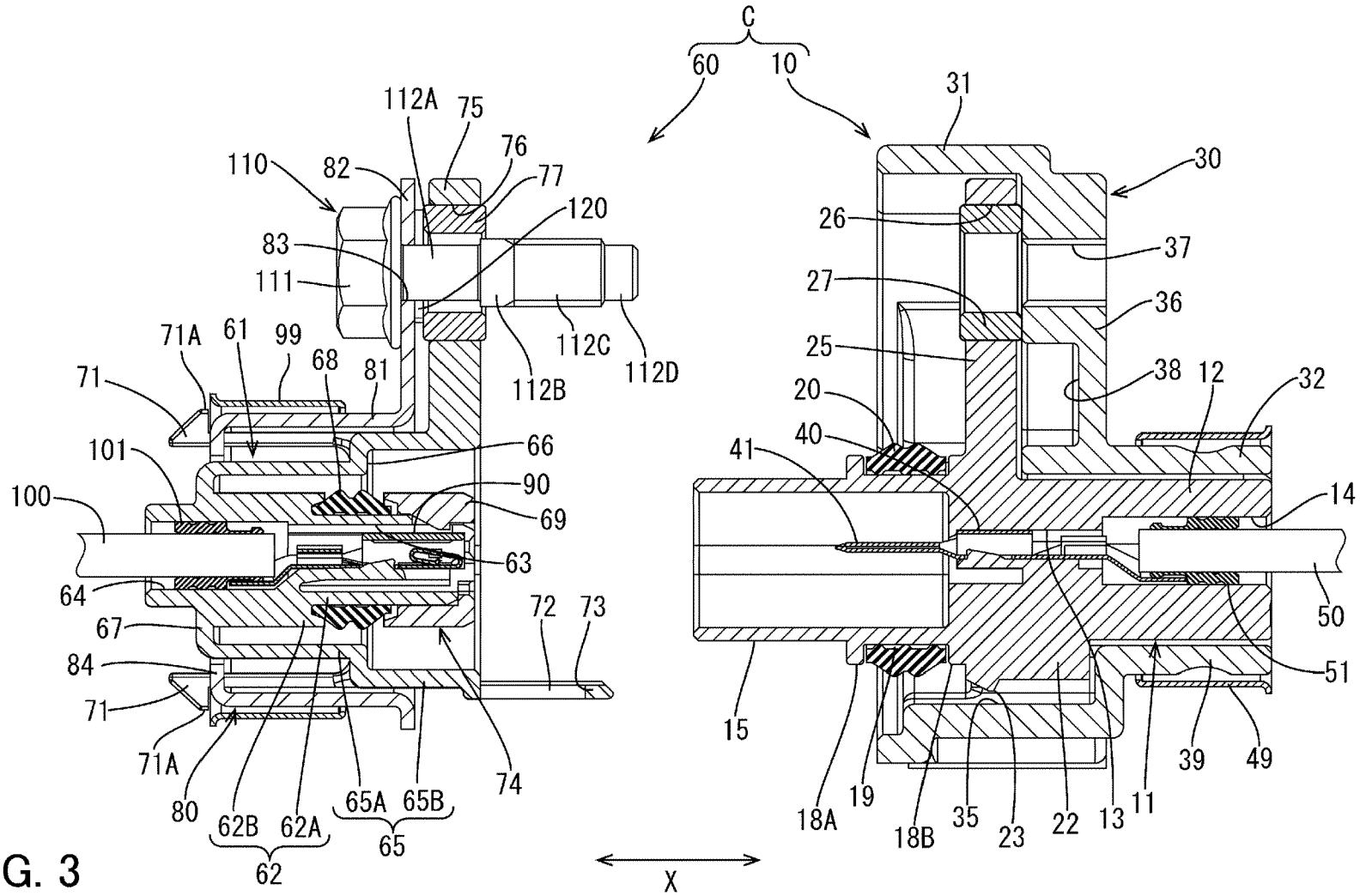
FIG. 3 is a vertical cross-sectional view of the shield connector before mating.
Figure 4:
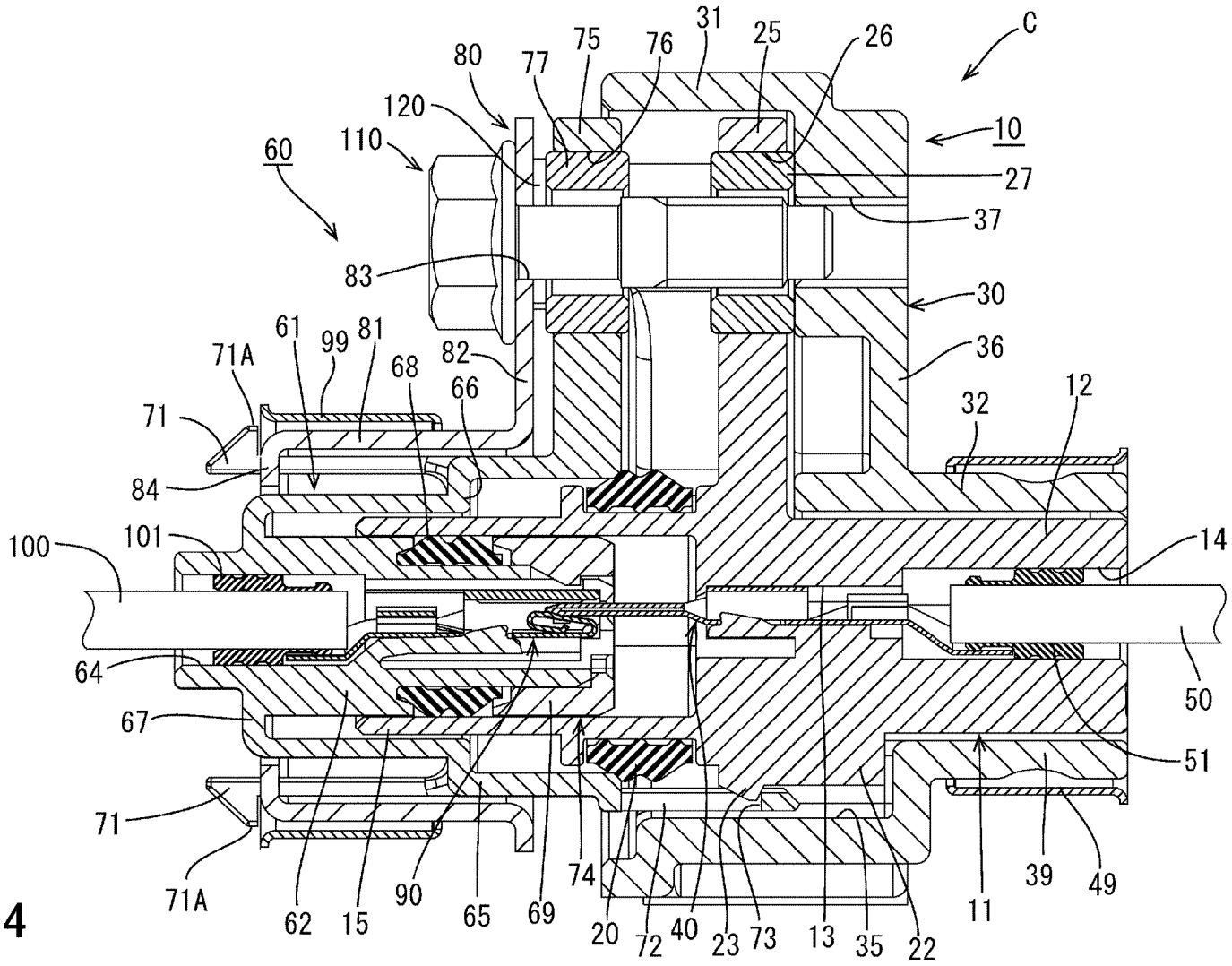
FIG. 4 is a vertical cross-sectional view of the shield connector during temporary mating.

The shield connector C in this embodiment is provided with a male-side connector 10 and a female-side connector 60 that are fitted together. This shield connector C can supply power, for example, to the air conditioner or the like in an electric automobile or a hybrid electric automobile or the like. In the explanation of each component below, the mating direction for both connectors 10, 60 is forward, the upper side in FIG. 3 is upward, and the lower side is downward.

Figure 6:
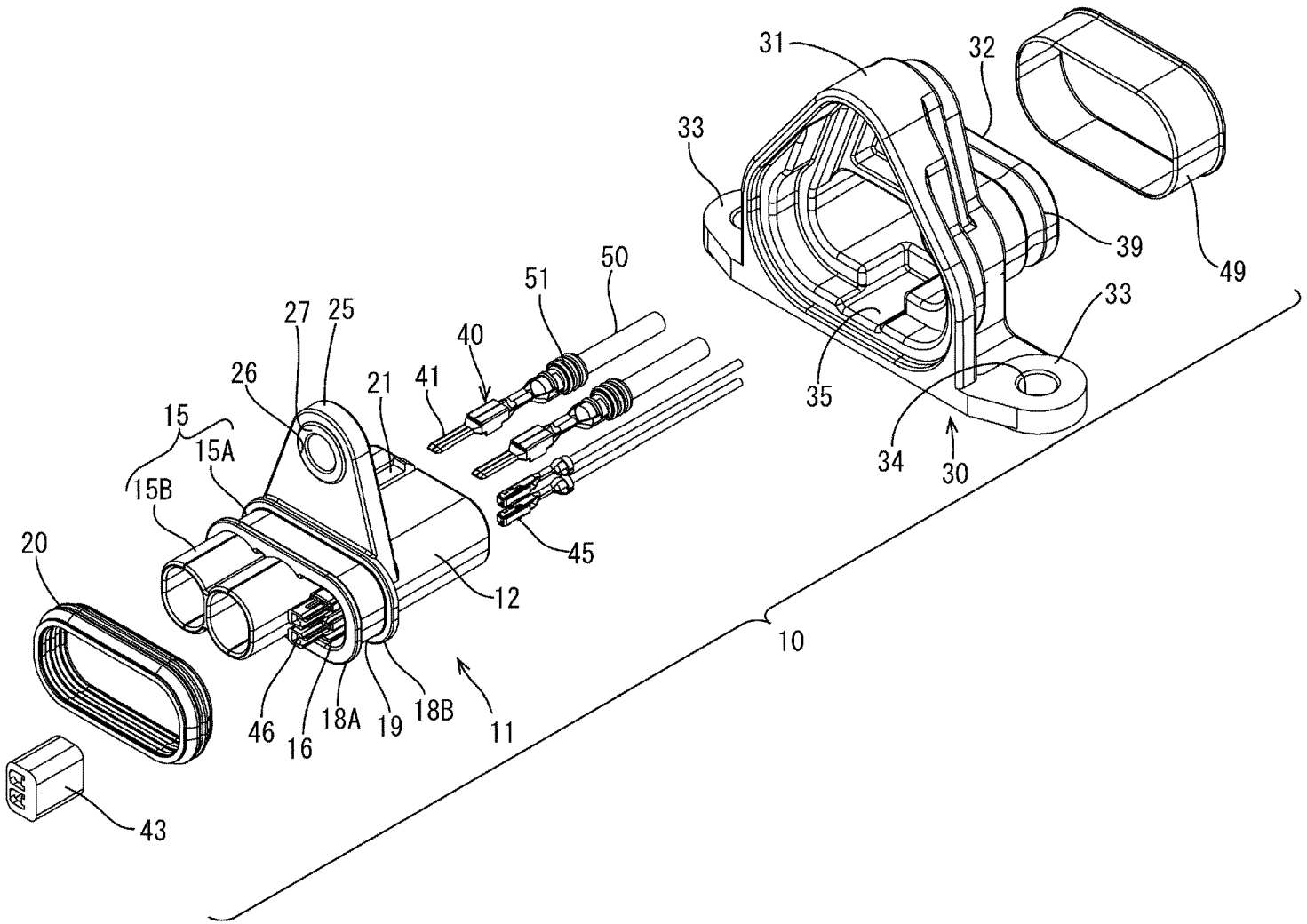
FIG. 6 is an exploded perspective view of a male-side connector.

As shown in FIG. 6, the male-side connector 10 is equipped with a male-side housing 11 (first housing) made of a synthetic resin, an electrically conductive male-side shell 30 (first shell) that covers the male-side housing 11, male terminals 40 connected to shielded wires 50, and interlock terminals 45.

Figure 7:
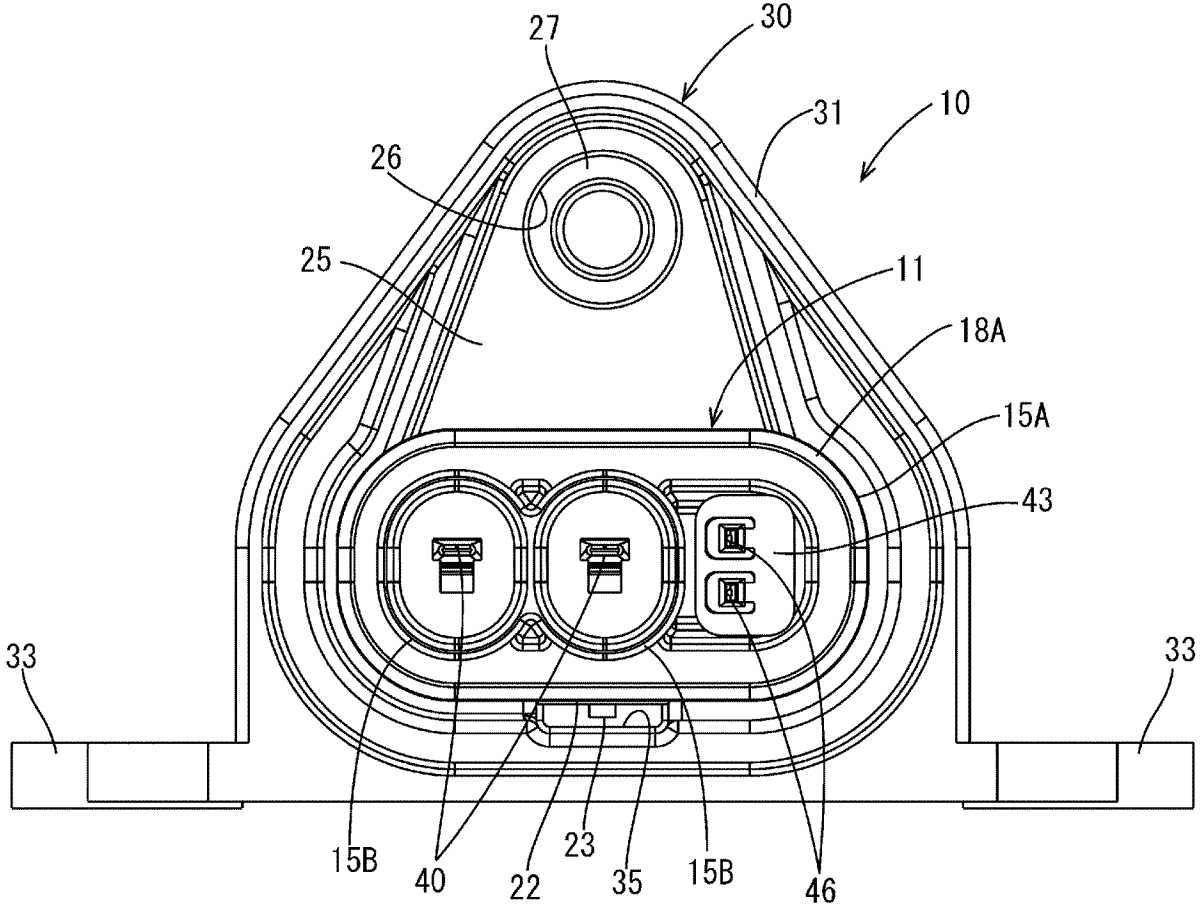
FIG. 7 is a front view of the male-side connector.
Figure 8:
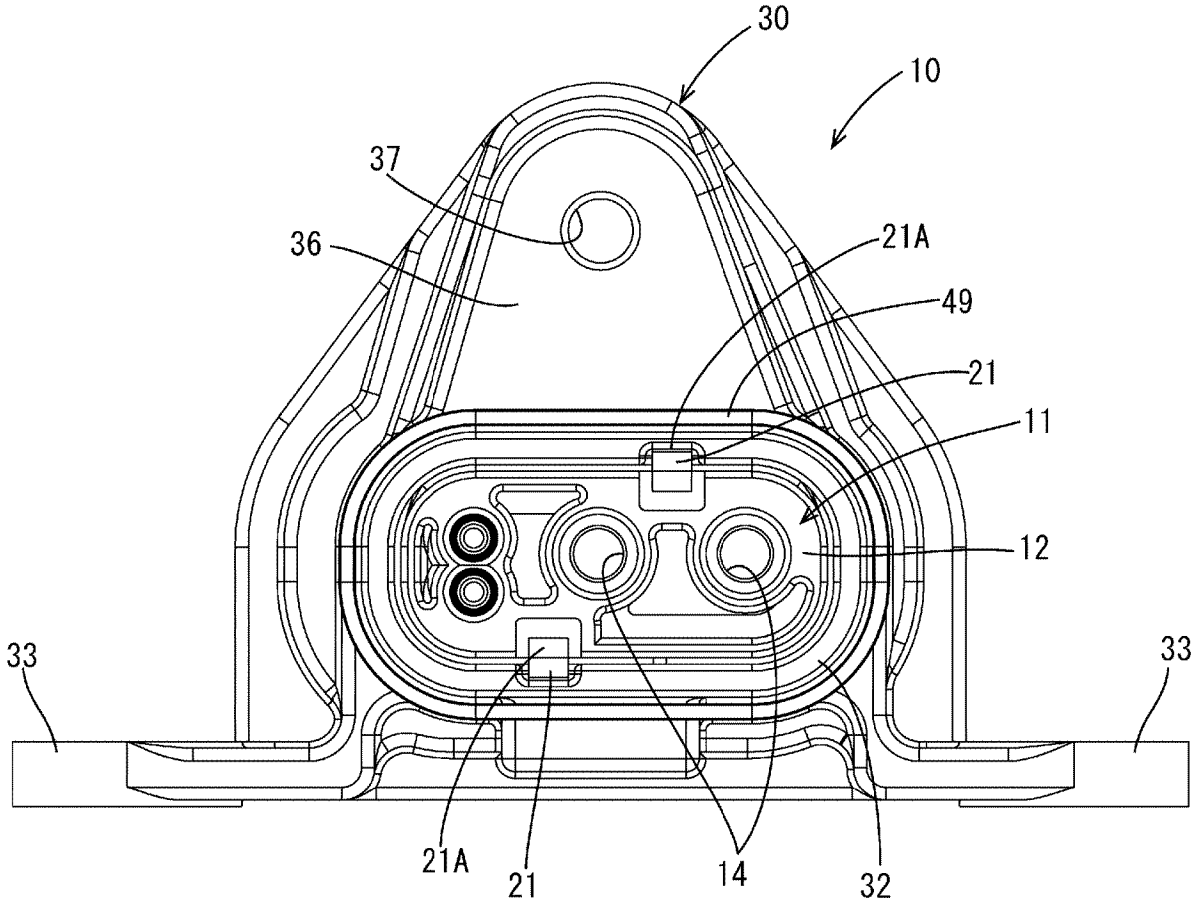
FIG. 8 is a rear view of the male-side connector.

The male-side housing 11 has a terminal accommodating portion 12 equipped with a cavity 13 that accommodates a pair of male terminals 40 therein. The terminal accommodating portion 12 has an oval-shaped cross-sectional profile that is long in the width direction and, as shown in FIG. 7, the pair of male terminals 40 are arranged side by side in the width direction. A pair of the interlock terminals 45 and a pair of relay terminals 46 connected to the pair of interlock terminals 45 are arranged in one row aligned vertically at one end in the width direction.

Each male terminal 40 has a slender profile in the longitudinal direction. The rear end of each male terminal 40 is connected to a shielded wire 50, and the front end has a tab-shaped terminal connecting portion 41 electrically connected to a female terminal 90 in the female-side connector 60. Each male terminal 40 is held in the cavity 13 and kept from becoming detached by a lance (see FIG. 3).

Along with the proper engagement of the male-side connector 10 and the female-side connector 60, the interlock terminals 45 are connected to a short terminal 95, described below, that is held in the female-side connector 60. When the interlock terminals 45 and the short terminal 95 have been connected, an interlock circuit is turned ON and a circuit in a device connected to the male-side connector 10 is made conductive. When the interlock terminals 45 and the short terminal 95 have been disconnected, the interlock circuit is turned OFF and the circuit in the device is broken.

As shown in FIG. 3, a pair of wire insertion holes 14 is provided at the rear end of the cavity 13 of the terminal accommodating portion 12 to accommodate the shielded wires 50. A rubber plug 51 is fitted over each of the shielded wires 50, and a plurality of outer ribs on the rubber plugs 51 seal against inner peripheral surfaces of the wire insertion holes 14. In this way, a water-tight seal is provided between the outer peripheral surface of the shielded wires 50 and the inner peripheral surface of the wire insertion holes 14, and water is suppressed from entering the wire insertion holes 14.

A male-side hood portion 15 is provided at the front of the terminal accommodating portion 12, which surrounds the terminal connecting portions 41 of the pair of male terminals 40 protruding from the cavity 13. As shown in FIG. 3 and FIG. 6, the male-side hood portion 15 has an outer hood portion 15A connected to the outer surface of the terminal accommodating portion 12 and extending forward, and a pair of inner hood portions 15B that individually surround the pair of tab-shaped terminal connecting portions 41 at the inside of the outer hood portion 15A in a radial direction. Each inner hood portions 15B extends forward from the front surface of the terminal accommodating portion 12, and the distal ends of the hood portions 15B protrude farther forward than the distal end of the outer hood portion 15A. The upper surface and the lower surface of the hood portions 15B are integrated with the outer hood portion 15A.

Additionally, a housing attachment portion 16 is provided on the front surface of the terminal accommodating portion 12 in alignment with the pair of inner hood portions 15B, to which is attached an interlock housing 43, described below, that receives the short terminal 95. A pair of relay terminals 46 is held in the housing attachment portion 16.

A first rib 18A and a second rib 18B, standing erect around the outer peripheral surface outwardly in the radial direction, are respectively provided at (i) the leading edge of the outer hood portion 15A and (ii) a position corresponding to the front surface of the terminal accommodating portion 12, separated from the leading edge of the outer hood portion 15A at a specified dimension. A recessed portion between the pair of ribs 18A, 18B forms a shield ring attachment portion 19 that receives a male sealing ring 20. The male sealing ring 20 fitted into the sealing ring attachment portion 19 seals against the inner surface of a female-side hood portion 65 (large-diameter portion 65B) of a female-side housing 61 described below. This achieves water tightness between the male-side connector 10 and the female-side connector 60 (see FIG. 5).

A pair of locking arms 21 for holding the male-side shell 30 are provided at the rear edge of the upper surface and the lower surface of the terminal accommodating portion 12. Each locking arm 21 is elastically deformed inwardly in the radial direction of the terminal accommodating portion 12 when the male-side shell 30 is fitted over the male-side housing 11 from the rear, and elastically returns when the male-side shell 30 reaches the proper position. A locking claw 21A provided at the distal end of the locking arm 21 then locks with the edge portion inside a notched portion (not shown) provided at the rear edge of the male-side shell 30. This pair of locking arms 21 are provided in different positions in the width direction of the terminal accommodating portion 12 (see FIG. 8). Additionally, each locking claw 21A has a height such that, when it engages the edge portion of the notched portion of the male-side shell 30 (rear tubular portion 32), the protruding end does not project outward from the outer surface of the rear tubular portion 32.

A somewhat wide guide portion 22 is provided on the lower surface of the terminal accommodating portion 12 that, as shown in FIG. 3 and FIG. 7, is linked to the rear surface of the second rib 18B, juts downward from the second rib 18B, and extends to the vicinity of the wire insertion holes 14 in the longitudinal direction. The guide portion 22 guides the male-side shell 30 into an attitude of engagement with a guide recessed portion 35, described below, when the male-side shell 30 is fitted over the male-side housing 11.

Also, a locking claw 23 protruding downward is provided at the center of the tip of the guide portion 22 in the width direction. The locking claw 23 keeps the female-side housing 61 described below from becoming detached while the female-side connector 60 is being mated with the male-side connector 10.

The male-side housing 11 in the present embodiment is equipped with a male-side fixing portion 25 (an example of a first fixing portion) for fixing with the male-side shell 30 and holding the engagement with the mated female-side housing 61. The male-side fixing portion 25 is a mountain-shaped plate linked to the rear surface of the second rib 18B and standing outward (upwardly) from the upper surface of the terminal accommodating portion 12 in the radial direction. A male-side bolt insertion hole 26 is provided near the tip of the male-side fixing portion 25 for receiving a fastening bolt 110 (an example of a fastening member), described below. A collar 27 made of a metal such as copper or iron or the like is fitted into the male-side bolt insertion hole 26 to cover the inner circumferential surface of the hole.

The aluminum die-cast male-side shell 30 has an overall tubular shape that is open in the longitudinal direction, and has a front tubular portion 31 (an example of a shielding portion) covering a front side of the male-side housing 11 and a rear tubular portion 32 covering the rear side. These tubular portions are integrated via a connecting wall 36 (an example of a first connecting portion).

More specifically, as shown in FIG. 3, the front tubular portion 31 covers the front portion of the terminal accommodating portion 12, including the male-side fixing portion 25, from the vicinity of a position somewhat forward of the front of the terminal accommodating portion 12 (rear end of the first rib 18A), and the rear tubular portion 32 covers the rear portion of the terminal accommodating portion 12 after stepping down in a constricting direction from the rear edge of the front tubular portion 31. The connecting wall 36 that integrally connects the front tubular portion 31 and the rear tubular portion 32 is arranged along the rear surface of the male-side fixing portion 25 of the male-side housing 11.

The front tubular portion 31 has a substantially triangular profile when viewed from the front and is able to receive the male-side fixing portion 25 and the terminal accommodating portion 12. A pair of fixing pieces 33 are provided on the lower edge of a pair of side walls of the front tubular portion 31, extend in the width direction, and are fixed to a fixed portion such as a case. Fixing holes 34 are provided in these fixing pieces 33 for receiving bolts (not shown).

Additionally, the guide recessed portion 35 is provided in the bottom wall of the front tubular portion 31. The guide recessed portion 35 opens toward the front, extends in the longitudinal direction, and is recessed towards the outside from the inside. When the male-side housing 11 is fitted into the male-side shell 30 (front tubular portion 31), the attitudes of both components are guided by the guide portion 22 of the male-side housing 11 being fitted into the guide recessed portion 35. The dimensions are established such that a gap can be formed between the bottom portion (upper surface) of the guide recessed portion 35 and the lower surface of the guide portion 22 (see FIG. 3) and such that a guide piece 72 on the female-side housing 61 described below can be inserted into the gap (see FIG. 3 to FIG. 5).

The dimensions of the front tubular portion 31 are established such that, when the male-side connector 10 and female-side connector 60 are mated (see FIG. 5), the front tubular portion 31 extends to a position at which it covers the periphery of a protruding wall 82 arranged at the rear surface of the female fixing portion 75, described below. In other words, the distal end of the front tubular portion 31 protrudes forward beyond the male-side fixing portion 25 when the male-side shell 30 is fitted over the male-side housing 11 (see FIG. 3).

In the connecting wall 36 connecting the front tubular portion 31 to the rear tubular portion 32, a shell-side bolt insertion hole 37 is provided at a position corresponding to the male-side bolt insertion hole 26 in the male-side housing 11, and a female thread (an example of a fastened portion) able to engage a male thread (an example of a fastening portion) on the fastening bolt 110 described below are formed on the inner circumferential surface of the hole 37. The rear surface of the collar 27 attached to the male-side bolt insertion hole 26 of the male-side housing 11 makes contact with the peripheral edge of the shell-side bolt insertion hole 37.

Additionally, in the connecting wall 36, a reduced thickness portion 38 is provided in a peripheral area of the shell-side bolt insertion hole 37 and a peripheral area of the terminal accommodating portion 12, which makes the wall thinner.

Meanwhile, a thin portion 39 extending circumferentially is provided on the rear tubular portion 32, at which a clinch ring 49 is compressed after the male-side shell 30 has been fitted over the male-side housing 11. Notched portions (not shown) are provided in the male-side housing 11 at positions corresponding to the locking claws 21A on the pair of locking arms 21 to accommodate the locking claws 21A and lock them to the edge portions. These notched portions have a depth that keeps the tips of the locking arms 21 from projecting beyond the rear edge of the rear tubular portion 32 when the locking claws 21A are locked to the edge portions.

Figure 9:
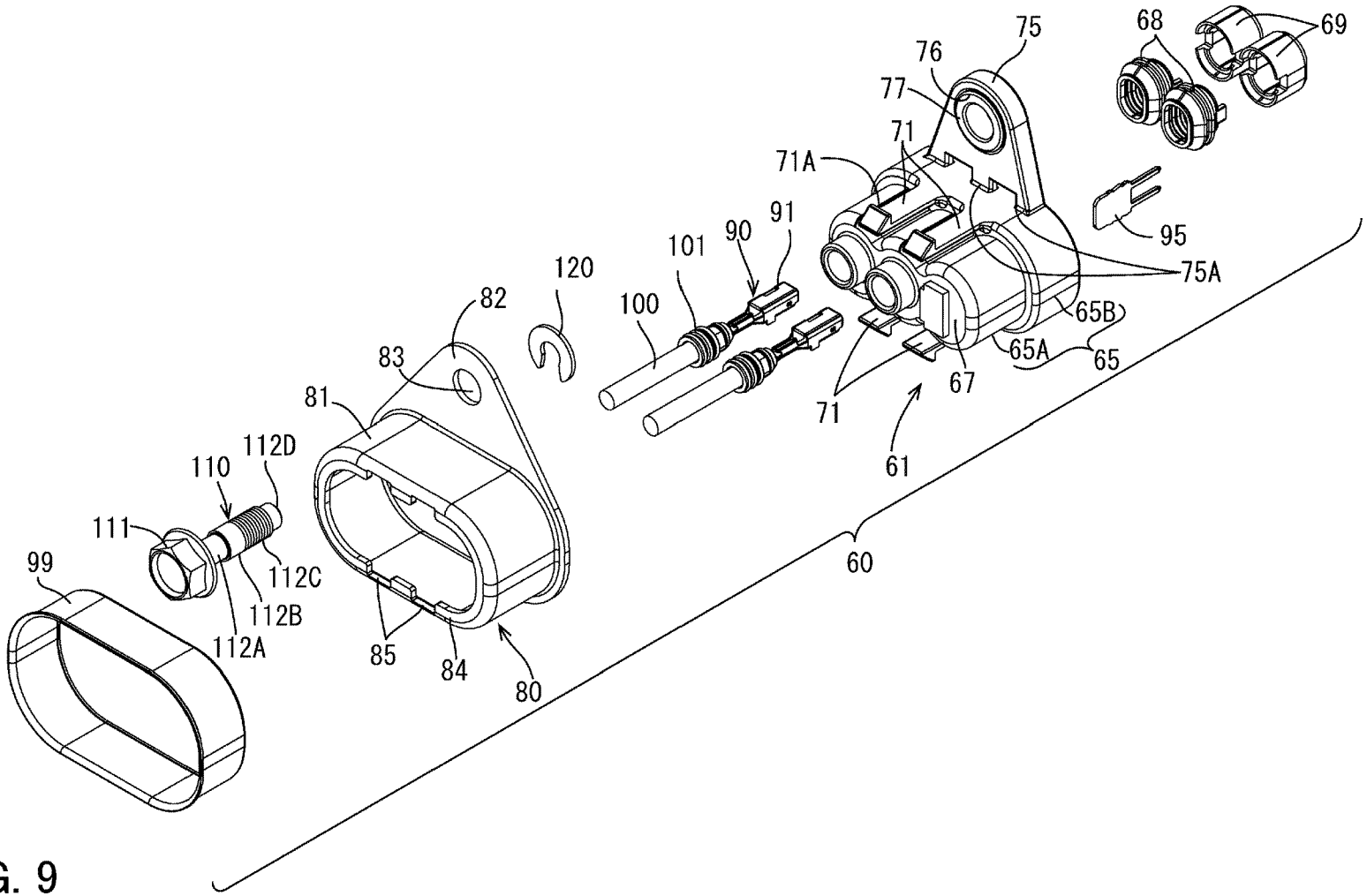
FIG. 9 is an exploded perspective view of a female-side connector.

As shown in FIG. 9, the female-side connector 60 is equipped with a female-side housing 61 (an example of a second housing) made of a synthetic resin, an electrically conductive female-side shell 80 (an example of a second shell) that covers the female-side housing 61, female terminals 90 connected to shielded wires 100, and the short terminal 95 that connects to the interlock terminals 45.

As shown in FIG. 3, the female-side housing 61 has terminal accommodating portions 62 equipped with cavities 63 that accommodate a pair of female terminals 90 respectively therein, and a female-side hood portion 65 that covers the terminal connecting portions 62 from the outside and receives the male-side housing 11.

The terminal accommodating portions 62 are a pair of substantially column shaped portions engageable into the inner hood portions 15B of the male-side housing 11, and the rear ends of the terminal accommodating portions 62 are integrated with a rear wall 67.

Each female terminal 90 has a slender profile in the longitudinal direction. Their rear ends are connected to shielded wires 100, and their front ends form tubular terminal connecting portions 91 that receive and are electrically connected to the tab-shaped terminal connecting portions 41 of the male-side connectors 10. Each female terminal 90 is kept from becoming detached from the cavity 63 by a lance.

As in the case of the male-side housing 11, a pair of wire insertion holes 64 are provided at the rear end of the cavities 63 of the terminal accommodating portions 62 to accommodate the shielded wires 100. Rubber plugs 101 are fitted over each of the shielded wires 100, and outer ribs on the rubber plugs 101 seal against the inner peripheral surface of the wire insertion holes 64. In this way, a water-tight seal is provided between the outer peripheral surface of the shielded wires 100 and the inner peripheral surface of the wire insertion holes 64, and water is suppressed from entering the wire insertion holes 64.

In the terminal accommodating portions 62, a smaller diameter portion 62A is provided at the front (the right side in FIG. 3) and a larger diameter portion 62B projects outward beyond the smaller diameter portion 62A at the rear to form a stepped profile. Female sealing rings 68 fitted over from the front come into contact with the stepped portions between the smaller diameter portions 62A and the larger diameter portions 62B, and the female sealing rings 68 are kept from becoming detached by retainers 69 fitted over from the front. The assembled terminal accommodating portions 62, female sealing rings 68, and retainers 69 form inner fitted portions 74 that are fitted into the male-side hood portion 15.

Additionally, an accommodating recessed portion 70 (see FIG. 10) is provided in the rear wall 67 of the female-side housing 61, aligned with the pair of terminal accommodating portions 62, and is recessed towards the rear to receive the interlock housing 43. The connection portions of the short terminal 95 are held in the accommodating recessed portion 70 so that they protrude forward. The short terminal 95 is a substantially U-shaped metal plate and is connected via the relay terminals 46 to the interlock terminals 45 when the male-side connector 10 is mated with the female-side connector 60.

Figure 5:
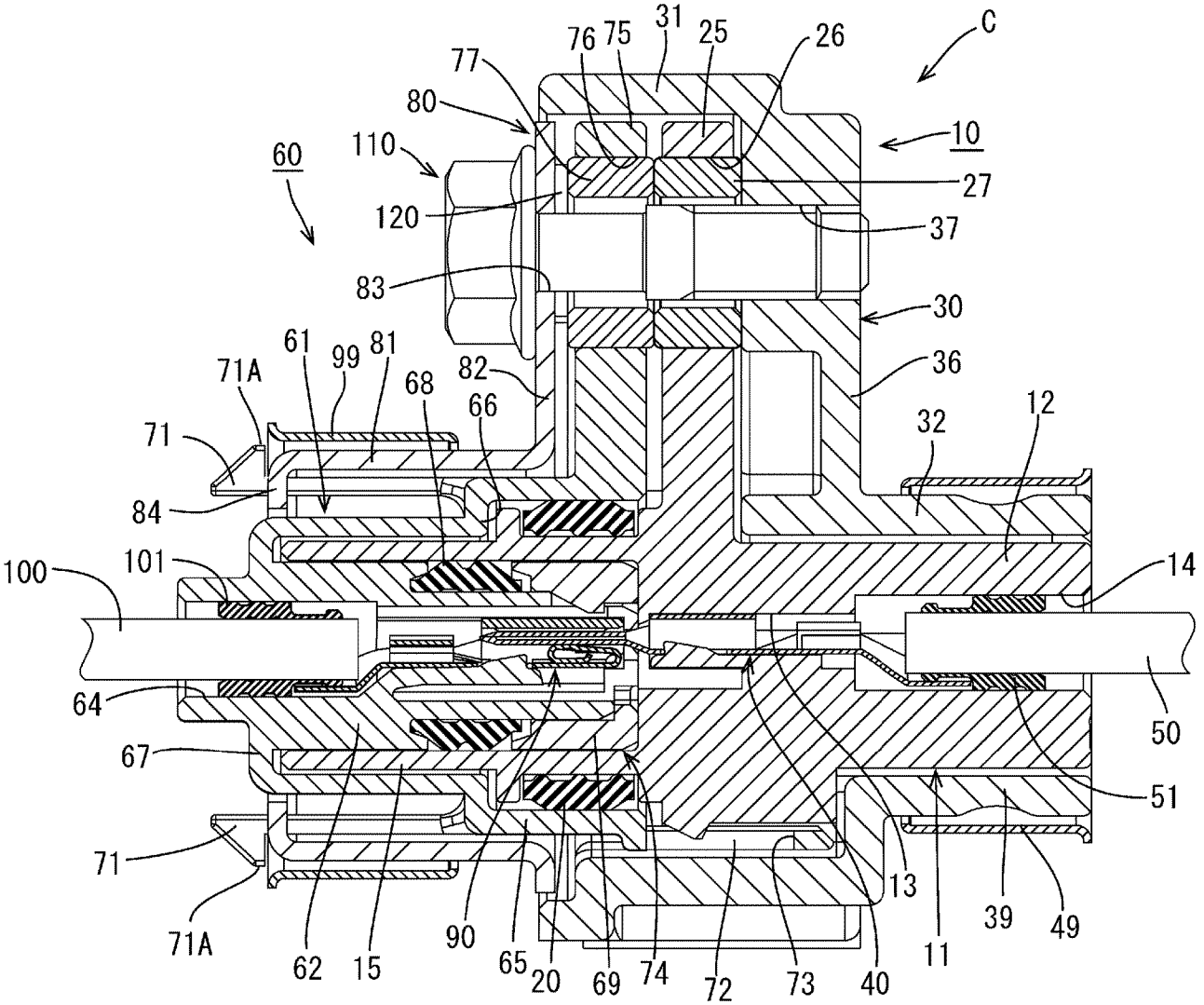
FIG. 5 is a vertical cross-sectional view of the shield connector when mated.

In the female-side hood portion 65 that covers the terminal accommodating portions 62, a smaller diameter portion 65A is provided at the rear side and a larger diameter portion 65B, of larger diameter than the smaller diameter portion 65A, is provided at the front side to form a stepped profile. As shown in FIG. 5, a stepped portion 66 between the smaller diameter portion 65A and the larger diameter portion 65B is positioned such that the first rib 18A can be accommodated inside the female-side hood portion 65 when the male-side housing 11 is mated.

As shown in FIG. 9, four cantilevered locking arms 71 extending to the rear are provided at the stepped portion 66 of the female-side housing 61 to form pairs on the upper surface and the lower surface of the female-side housing 61. These locking arms 71 are used to lock the female-side shell 80 described below. Each locking arm 71 is elastically deformed inwardly in the radial direction of the terminal accommodating portion 62 when the female-side shell 80 is fitted over the female-side housing 61 from the rear, and elastically returns when the female-side shell 80 reaches the proper position. A locking claw 71A provided on the tip then locks with a rear edge of the female-side shell 80.

As shown in FIGS. 3-5 and 10, a cantilevered guide piece 72 extending forward is provided at a central portion on the lower end of the female-side hood portion 65. A groove portion 73 extending in the longitudinal direction is provided in the guide piece 72 so as to pass through the guide piece 72 and has, overall, an elongate U-shaped profile. The guide piece 72 has a width dimension enabling the piece to be inserted into the guide recessed portion 35 described above.

Figure 10:
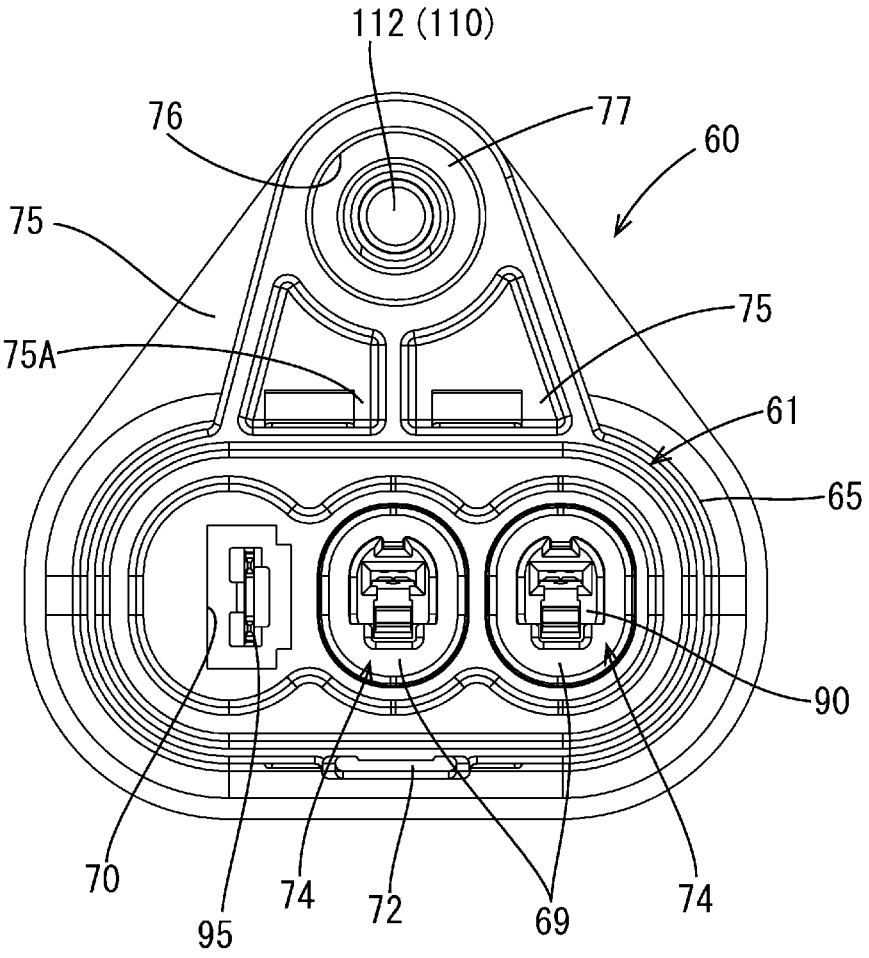
FIG. 10 is a front view of the female-side connector.

The female-side housing 61 is equipped with a female-side fixing portion 75 (example of a second fixing portion) for fixing the female-side shell 80 and holding the mated state of the female-side shell 80 with the male-side housing 11. As shown in FIGS. 9-10, the female-side fixing portion 75 has three leg portions 75A standing erect (upwardly) from the upper surface of the leading edge of the female-side hood portion 65, and is a mountain-shaped plate that substantially exactly overlaps the male-side fixing portion 25 described above. A female-side bolt insertion hole 76 is provided in the female-side fixing portion 75 at a position corresponding to the male-side bolt insertion hole 26 in the male-side fixing portion 25 for receiving the fastening bolt 110 (example of a fastening member). A collar 77 made of a metal such as copper or iron is fitted into the female-side bolt insertion hole 76 so as to cover the inner circumferential surface of the hole.

As shown in FIG. 9, the aluminum die-cast female-side shell 80 forms a tube with a substantially oval profile and is open in the longitudinal direction, overall. The female-side shell 80 has a tubular portion 81 that covers the periphery of the female-side hood portion 65 of the female-side housing 61, and a standing wall 82 (example of a second connecting portion) standing erect upwardly from the leading end of the tubular portion 81. The standing wall 82 is a mountain-shaped plate that is positioned along the rear surface of the female-side fixing portion 75. The standing wall 82 also has a shell-side bolt insertion hole 83 for the female-side shell 80 which is provided at a position corresponding to the female-side bolt insertion hole 76 in the female-side fixing portion 75.

Additionally, the rear edge of the tubular portion 81 forms a detachment preventing wall 84 that curves inwardly in the radial direction. Furthermore, the detachment preventing wall 84 has notched portions 85 at positions corresponding to the locking arms 71 of the female-side housing 61, enabling the tips of the locking arms 71 to pass through. The female-side shell 80 is held to the female-side housing 61 by the locking claws 71A provided at the tips of the locking arms 71.

A clinch ring 99 is crimped against the outer periphery of the tubular portion 81 after the female-side shell 80 has been fitted over the female-side housing 61.

The male-side connector 10 and the female-side connector 60 are held in the mated state by the electrically conductive fastening bolt 110. The fastening bolt 110 used in the present embodiment is a bolt with a hexagonal flange, and the shaft portion 112 of the bolt has, in order from the head 111, four sections, namely, a base portion 112A, a larger diameter portion 112B, a threaded portion 112C, and a tip portion 112D. More specifically, the diameters of the base portion 112A and the tip portion 112D are relatively small, the diameters of the larger diameter portion 112B and the threaded portion 112C are relatively large, and a male thread is formed only at the threaded portion 112C. This male thread enables the bolt to be screwed into the female thread formed in the shell-side bolt insertion hole 37 in the male-side shell 30. Additionally, the outer diameters of the larger diameter portion 112B and the threaded portion 112C are somewhat smaller than the inner diameter of the collar 27 of the male-side fixing portion 25 and the collar 77 of the female-side fixing portion 75.

The shield connector C in the present embodiment is assembled in the following way.

First, the male sealing ring 20 and the interlock housing 43 are assembled to the male-side housing 11 in which the collar 27 and the relay terminals 46 are held, and the male terminals 40, which have been connected to the shielded wires 50 in advance, are inserted into the cavity 13 from the rear. At this time, the male terminals 40 with the shielded wires attached are passed through the clinch ring 49 and the male-side shell 30 in advance. When the male terminals 40 are pressed into the cavity 13 to the proper positions, they are kept from being detached by lances. The plurality of ribs on the rubber plugs 51 fitted over the shielded wires 50 are pressed against the inner circumferential surfaces of the wire insertion holes 14 to provide a water-tight seal.

Next, the male-side shell 30 is fitted over the male-side housing 11 from the rear. At this time, the guide portion 22 of the male-side housing 11 is inserted into the guide recessed portion 35 of the male-side shell 30, and the male-side fixing portion 25 is inserted along the inner circumferential surface of the front tubular portion 31, whereby both parts are guided into a proper engaging attitude.

Also, at this time, the pair of locking arms 21 on the male-side housing 11 (see FIGS. 6 and 8) are elastically deformed inwardly in the radial direction by the rear tubular portion 32 of the male-side shell 30. The male-side housing 11 is then inserted into the interior of the male-side shell 30. When it reaches the proper mating position, the locking claws 21A at the tips of the locking arms 21 pass through the rear tubular portion 32, and elastically return to their original position to lock against the rear edge of the notched portions in the male-side shell 30. In this way, the male-side housing 11 is kept from becoming detached from the inside of the male-side shell 30. Additionally, in this state, the collar 27 abuts the connecting wall 36 (see FIG. 3).

Finally, the clinch ring 49 is forcibly fitted onto the rear end (rear tubular portion 32) of the male-side shell 30. Thereby, the male-side connector 10 is complete.

Meanwhile, the female terminals 90 with the shielded wires attached are passed through the female-side shell 80 and the clinch ring 99 in advance and are inserted into the cavity 63 in the female-side housing 61, in which are held the collar 77 and the short terminal 95. When the female terminals 90 are inserted to the proper positions in the cavity 63, they are kept from being detached by lances. Additionally, the plurality of ribs on the rubber plugs 101 fitted over the shielded wires 100 are pressed against the inner circumferential surfaces of the wire insertion holes 64 to provide a water-tight seal.

Next, the female sealing rings 68 and the retainers 69 are fitted in successive order over the smaller diameter portions 62A of the terminal accommodating portions 62 from the front of the female-side housing 61. The female sealing rings 68 are interposed between the retainers 69 and the stepped portions between the smaller diameter portions 62A and the larger diameter portions 62B to prevent detachment.

Next, the female-side shell 80 is fitted over the female-side housing 61 from the rear. At this time, the four locking arms 71 on the female-side housing 61 are elastically deformed inwardly in the radial direction by the tubular portion 81 of the female-side shell 80. The female-side housing 61 passes into the interior of the female-side shell 80. When it reaches the proper mating position, the locking claws 71A at the tips of the locking arms 71 pass through the notched portions 85 of the tubular portion 81, and elastically return to their original position to lock against the rear edge of the notched portions in the female-side shell 80 (inside the notched portions 85). In this way, the female-side housing 61 is kept from becoming detached from inside the female-side shell 80. Additionally, in this state, a small space is formed between the collar 77 and the standing wall 82, into which a C ring 120 can be inserted as described below.

Finally, the clinch ring 99 is forcibly fitted over the rear end of the female-side shell 80. Thereby, the female-side connector 60 is complete.

When the thus-assembled male-side connector 10 and female-side connector 60 are mated, first, as shown in FIG. 3, the shaft portion 112 of the fastening bolt 110 is inserted from the rear of the female-side connector 60 into the shell-side bolt insertion hole 83 and the collar 77 of the female-side bolt insertion hole 76. At this time, because the tip portion 112D of the shaft portion 112 has a small diameter, it can be inserted relatively easily into the shell-side bolt insertion hole 83. The electrically conductive C ring 120 is then pushed into the space between the standing wall 82 and the female-side fixing portion 75 to engage the shaft portion 112 of the fastening bolt 110.

Next, the mating surfaces of the male-side connector 10 and female-side connector 60 are brought closer to each other, and the male-side hood portion 15 of the male-side connector 10 is fitted into the space between (i) the inner fitted portions 74 of the female-side connector 60 and (ii) the female-side hood portion 65.

Next, the guide piece 72 on the female-side housing 61 is inserted into the space between (i) the guide portion 22 of the male-side housing 11 and (ii) the guide recessed portion 35 of the male-side shell 30, thereby guiding the mating attitude of both parts. At this time, the guide piece 72 proceeds forward while being pressed down by the locking claw 23. When the locking claw 23 reaches the groove portion 73 of the guide piece 72, the guide piece 72 elastically recovers, and the leading end of the guide piece 72 (edge portion of the groove portion 73) is locked by the locking claw 23 (see FIG. 4).

In this state, the shaft portion 112 of the fastening bolt 110 is passed though the collar 27 of the male-side bolt insertion hole 26, and the tip portion 112D enters the shell-side bolt insertion hole 37 in the male-side shell 30. Also, the leading end of the threaded portion 112C of the shaft portion 112 is in a state just before reaching the inside of the shell-side bolt insertion hole 37 (female thread), or a state of abutting against the inside of the shell-side bolt insertion hole 37.

Also, in this state, the male-side connector 10 and the female-side connector 60 are easily held in a state of being kept from separating and becoming detached, by the engagement of (i) the locking claw 23 and (ii) the groove portion 73 of the guide piece 72 (an example of the locking mechanism). Also, because the leading end of the threaded portion 112C of the fastening bolt 110 abuts against the female thread of the shell-side bolt insertion hole 37, the mating cannot proceed further in that state. Thus, the engagement of (i) the locking claw 23 and (ii) the groove portion 73 of the guide piece 72 locks the first housing and the second housing together in a state in which the male-side fixing portion 25 and the female-side fixing portion 75 are farther apart than in a completely mated state of the shield connector.

Next, the head 111 of the fastening bolt 110 is rotated to fasten the male thread of the threaded portion 112C into the female thread formed in the shell-side bolt insertion hole 37. In this way, the male-side connector 10 and the female-side connector 60 are brought together until they are in a properly mated state (the completely mated state of the shield connector). When the mating operation has been completed, the standing wall 82 of the female-side shell 80, the C ring 120, the female-side fixing portion 75 of the female-side housing 61, the male-side fixing portion 25 of the male-side housing 11, and the connecting wall 36 of the male-side shell 30 are tightened and brought into close contact (see FIG. 5).

In this state, the female-side shell 80 and the male-side shell 30 are electrically connected to each other not only via the fastening bolt 110 but also via the electrically conductive C ring 120, collar 77, and collar 27 which are in contact with each other.

With the shield connector C of the present embodiment, the male-side fixing portion 25 and the female-side fixing portion 75 are fastened to each other by a fastening bolt 110 while being interposed between the connecting wall 36 and the standing wall 82. That is, because the male-side housing 11 and the male-side shell 30, and the female-side housing 61 and the female-side shell 80, are assembled together using a bolt, rattling is less likely to occur between the housings and the shells.

Also, because the male-side housing 11 and the female-side housing 61 are fastened by the fastening bolt 110, the housings 11, 61 are mated more firmly and are more vibration resistant.

In addition, these assembly operations can be completed simply by attaching a single fastening bolt 110. This is more efficient compared to the conventional structure, in which the shells and housings are assembled using separate fastening members and the shells are then attached to each other using another fastening member.

Also, because the electrically conductive collars 27, 77 are provided in the respective bolt insertion holes 26, 76 in the male-side fixing portion 25 and the female-side fixing portion 75, and a fastening bolt 110 is passed through these collars 27, 77, an electrical connection is established between the male-side shell 30 and the female-side shell 80 not only via the fastening bolt 110 but also via the collars 27, 77. In other words, the shielding performance is more reliable.

Also, because the male-side fixing portion 25 and the female-side fixing portion 75 are provided respectively in the male-side housing 11 and the female-side housing 61, and stand erect in a direction orthogonal to the mating direction X of the housings 11, 61, and the fixing portions 25, 75 are interposed between the connecting wall 36 of the male-side shell 30 and the standing wall 82 of the female-side shell 80, the overall configuration of and the assembly operation for the shield connector C can be made simple.

Also, because the front tubular portion 31 of the male-side shell 30 covers the periphery of the male-side fixing portion 25 and the female-side fixing portion 75 (the outside of the mated portion in the radial direction), the shielding performance of the electrically connected portions is more reliable.

Furthermore, because the locking claw 23 and the groove portion 73 in the guide piece 72 are locked together to prevent detachment of the male-side housing 11 and the female-side housing 61 in a state before the male thread formed on the threaded portion 112C of the fastening bolt 110 is screwed into the female thread formed in the inner circumferential surface of the shell-side bolt insertion hole 37 in the male-side shell 30, the male-side housing 11 and the female-side housing 61 are suppressed from becoming detached before the fastening operation of the fastening bolt 110 has been performed. This improves the assembly operation.

Other Embodiments

The technology disclosed in this specification is not limited to the embodiment described above and illustrated in the drawings. For example, embodiments such as the following are also include within the technical scope.

(1) In the embodiment described above, the male-side shell 30 and the female-side shell 80 were made of die-cast aluminum. However, the shell material and manufacturing method are not limited to those of the embodiment. For example, the shells may be manufactured by press-working, and/or may be made using a metal material other than aluminum, such as copper or the like.

(2) In the embodiment described above, the collars 27, 77 were forcibly inserted into the bolt insertion holes 26, 76 in the fixing portions 25, 75. However, they may be provided using insert molding. Alternatively, these collars may be omitted.

(3) In the embodiment described above, the fastening bolt 110 was screwed into (fastened into) a female thread provided in the shell-side bolt insertion hole 37. However, for example, it may also be fastened by newly providing another fastening member such as a nut or the like.

(4) The configuration of the fixing portions 25, 75 is not limited to that of the above-described embodiment. For example, they may extend in the same direction as the mating direction X.

(5) In the embodiment described above, the fixing portions 25, 75 are covered by the front tubular portion 31 (shielding portion) of the male-side shell 30. However, the fixing portions do not necessarily have to be covered.

(6) In the embodiment described above, the male-side housing 11 and the female-side housing 61 are kept from becoming detached by the engagement of the locking claw 23 and the groove portion 73 in the guide piece 72. However, this type of locking mechanism can be omitted.

DESCRIPTION OF SYMBOLS

10: Male-side connector
11: Male-side housing (first housing)
22: Guide portion
23: Locking claw (temporary locking mechanism)
25: Male-side fixing portion (first fixing portion)
26: Male-side bolt insertion hole
27: Collar
30: Male-side shell (shield shell, first shell)
31: Front tubular portion (shielding portion)
32: Rear tubular portion
35: Guide recessed portion
36: Connecting wall (first connecting portion)
37: Shell-side bolt insertion hole
40: Male terminal
60: Female-side connector
61: Female-side housing (second housing)
72: Guide piece
73: Groove portion (temporary locking mechanism)
75: Female-side fixing portion (second fixing portion)
76: Female bolt insertion hole
77: Collar
80: Female-side shell (shield shell, second shell)
82: Standing wall (second connecting portion)
83: Shell-side bolt insertion hole
90: Female terminal
110: Fastening bolt (fastening member)
112: Shaft portion
C: Shield connector
X: Mating direction

What is claimed is:

1. A shield connector comprising:
a first housing;
a second housing configured to be attached to the first housing;
a first shield shell configured to cover the first housing, the first shield shell being electrically conductive;
a second shield shell configured to cover the second housing, the second shield shell being electrically conductive;
the first shield shell including a first connecting portion and the second shield shell including a second connecting portion;
an electrically conductive fastening member that electrically connects the first connecting portion and the second connecting portion to each other;
the first housing including a first fixing portion configured to be fixed to the first shield shell;
the second housing including a second fixing portion configured to be fixed to the second shield shell; and
the first fixing portion and the second fixing portion being configured to be held together by the fastening member in a state in which the first fixing portion and the second fixing portion are interposed between the first connecting portion and the second connecting portion.

2. A shield connector according to claim 1, wherein electrically conductive collars are provided respectively in the first fixing portion and the second fixing portion, and the fastening member passes through the collars.

3. A shield connector according to claim 1, wherein the first fixing portion and the second fixing portion stand erect in a direction orthogonal to a mating direction of the first housing and the second housing.

4. A shield connector according to claim 1, wherein a shielding portion extending in a mating direction of the first housing and the second housing and covering a periphery of the first fixing portion and a periphery of the second fixing portion is provided on at least one of the first connecting portion and the second connecting portion.

5. A shield connector according to claim 1, further comprising a temporary locking mechanism that locks the first housing and the second housing together in a state before a fastening portion of the fastening member has been fastened to a fastened portion.

6. A shield connector according to claim 5, wherein the temporary locking mechanism locks the first housing and the second housing together in a state in which the first fixing portion and the second fixing portion are farther apart than in a completely mated state of the shield connector.

7. A shield connector according to claim 5, wherein the electrically conductive fastening member comprises a bolt, the fastening portion comprises a male thread of the bolt, and the fastened portion comprises a female thread formed in (i) a nut or (ii) a bolt insertion hole formed in one of the shield shells.

8. A shield connector according to claim 2, wherein the electrically conductive collars are configured to be in electrical contact with each other, and to provide electrical conductivity between the first shield shell and the second shield shell, in a completely assembled state of the shield connector.

9. A shield connector according to claim 1, wherein the electrically conductive fastening member comprises a bolt.

* * * * *